US010998678B1

(12) United States Patent
Miller et al.

(10) Patent No.: US 10,998,678 B1
(45) Date of Patent: May 4, 2021

(54) MODULAR ELECTRICAL CONNECTOR WITH ADDITIONAL GROUNDING

(71) Applicant: TE Connectivity Services GmbH, Schaffhausen (CH)

(72) Inventors: Keith Edwin Miller, Manheim, PA (US); Scott Eric Walton, Mount Joy, PA (US); Albert Tsang, Harrisburg, PA (US); Kevin Michael Thackston, York, PA (US); Kyle Gary Annis, Hummelstown, PA (US)

(73) Assignee: TE CONNECTIVITY SERVICES GmbH, Schaffhausen (CH)

( * ) Notice: Subject to any disclaimer, the term of this patent is extended or adjusted under 35 U.S.C. 154(b) by 0 days.

(21) Appl. No.: 16/830,391

(22) Filed: Mar. 26, 2020

(51) Int. Cl.

| | |
|---|---|
| ***H01R 13/648*** | (2006.01) |
| ***H01R 13/6471*** | (2011.01) |
| ***H01R 13/514*** | (2006.01) |
| ***H01R 13/6587*** | (2011.01) |
| ***H01R 13/6473*** | (2011.01) |

(52) U.S. Cl.
CPC ..... *H01R 13/6471* (2013.01); *H01R 13/514* (2013.01); *H01R 13/6473* (2013.01); *H01R 13/6587* (2013.01)

(58) Field of Classification Search
CPC ..... H01R 13/6471; H01R 13/6587; H01R 13/6461; H01R 13/6473; H01R 13/514
USPC ..... 439/607.06
See application file for complete search history.

(56) References Cited

U.S. PATENT DOCUMENTS

| | | | | |
|---|---|---|---|---|
| 5,795,191 | A * | 8/1998 | Preputnick | H01R 13/6587 439/607.11 |
| 6,171,115 | B1 | 1/2001 | Mickievicz et al. | |
| 6,267,604 | B1 | 7/2001 | Mickievicz et al. | |
| 6,347,962 | B1 * | 2/2002 | Kline | H01R 13/6473 439/607.07 |
| 6,384,341 | B1 | 5/2002 | Rothermel et al. | |
| 6,488,549 | B1 | 12/2002 | Weller et al. | |
| 6,540,522 | B2 | 4/2003 | Sipe | |
| 6,582,250 | B2 | 6/2003 | Taylor et al. | |
| 6,655,966 | B2 | 12/2003 | Rothermel et al. | |
| 6,663,426 | B2 | 12/2003 | Hasircoglu et al. | |
| 6,663,442 | B1 | 12/2003 | Helster et al. | |
| 6,676,450 | B2 | 1/2004 | Schroll | |
| 6,705,895 | B2 | 3/2004 | Hasircoglu | |
| 6,808,399 | B2 | 10/2004 | Rothermel et al. | |
| 6,811,414 | B1 | 11/2004 | Consoli et al. | |
| 6,811,440 | B1 | 11/2004 | Rothermel et al. | |
| 6,824,391 | B2 | 11/2004 | Mickievicz et al. | |

(Continued)

*Primary Examiner* — Khiem M Nguyen

(57) ABSTRACT

An electrical connector assembly which controls cross talk and signal radiation. Signal pathways are provided on modules in a first connector housing, with the signal pathways being arranged in differential pairs. Second ground pathways are positioned between side surfaces of the modules and respective signal pathways of the signal pathways. Signal contacts are positioned in the second connector housing. Second ground contacts are positioned in the second connector housing. The second ground contacts are positioned between side surfaces of the second modules and respective signal contacts of the signal contacts. The second ground pathways engage the second ground contacts of the second modules to balance the differential pairs of signal pathways to optimize impedance and shielding of the signal pathways.

20 Claims, 10 Drawing Sheets

(56) References Cited

U.S. PATENT DOCUMENTS

| | | | | |
|---|---|---|---|---|
| 6,890,214 | B2 | 5/2005 | Brown et al. | |
| 6,932,649 | B1 | 8/2005 | Rothermel et al. | |
| 6,945,810 | B1 | 9/2005 | Morana et al. | |
| 6,964,583 | B2 | 11/2005 | D'Ambrosia et al. | |
| 6,997,736 | B2 | 2/2006 | Costello et al. | |
| 7,044,794 | B2 | 5/2006 | Consoli et al. | |
| 7,175,445 | B2 | 2/2007 | Consoli et al. | |
| 8,840,431 | B2 | 9/2014 | Nguyen et al. | |
| 10,535,971 | B2 | 1/2020 | Annis et al. | |
| 2003/0143894 | A1* | 7/2003 | Kline ..... | H01R 13/6471 439/607.56 |

* cited by examiner

MODULAR ELECTRICAL CONNECTOR WITH ADDITIONAL GROUNDING

FIELD OF THE INVENTION

The present invention relates to a connector with additional ground surfaces to optimize impedance and shielding between pairs of signal pathways. In particular, the invention relates to a modular connector with enhanced grounding which is backward compatible with existing connectors.

BACKGROUND OF THE INVENTION

Due to the increasing complexity of electronic components, it is desirable to fit more components in less space on a circuit board or other substrate. Consequently, the spacing between electrical terminals within connectors has been reduced, while the number of electrical terminals housed in the connectors has increased, thereby increasing the need in the electrical arts for electrical connectors that are capable of handling higher and higher speeds and to do so with greater and greater pin densities. It is desirable for such connectors to have not only reasonably constant impedance levels, but also acceptable levels of impedance and cross-talk, as well as other acceptable electrical and mechanical characteristics. Therefore, there remains a need to provide appropriate impedance and shielding to preserve signal integrity and to minimize crosstalk as speeds of signals increase and the footprint of the connector remains the same or decreases.

It would, therefore, be beneficial to provide a connector with enhanced grounding to optimize impedance and shielding between signal pairs and reduce crosstalk between the signal pairs. It would also be beneficial to provide connector assemblies which are backward compatible with existing connectors.

SUMMARY OF THE INVENTION

An object is to provide a connector with enhanced shielding to optimize shielding between signal pairs and reduce crosstalk between the signal pairs, and which is backward compatible with existing connectors An embodiment is directed to an electrical connector assembly which controls cross talk and signal radiation. The electrical connector assembly include a first connector housing and a second connector housing.

The first connector housing has first modules positioned therein. The first modules have first mating ends and first mounting ends. The first modules have modules, with respective modules having first surfaces and oppositely facing second surfaces. Signal pathways are provided on the first surfaces, with the signal pathways being arranged in differential pairs. First ground pathways are provided on the first surfaces and extend from the first mating ends to the first mounting ends. Each of the first ground pathways are positioned adjacent the signal pathways. Second ground pathways are provided on the first surfaces. The second ground pathways are positioned between side surfaces of the modules and respective signal pathways of the signal pathways.

The second connector housing has second modules positioned therein. The second modules have second mating ends and second mounting ends. Signal contacts are positioned in the second modules. The signal contacts extend between the second mating ends and the second mounting ends. The signal contacts are arranged in pairs to carry differential signals First ground contacts are positioned in the modules, the ground contacts extend between the mating ends and the mounting ends, with the first ground contacts being positioned adjacent to respective signal contacts. Second ground contacts are positioned in the modules. The second ground contacts are positioned between side surfaces of the second modules and respective signal contacts. The second ground pathways engage the second ground contacts of the second modules to balance the differential pairs of signal pathways to optimize impedance and shielding of the signal pathways.

Other features and advantages of the present invention will be apparent from the following more detailed description of the illustrative embodiment, taken in conjunction with the accompanying drawings which illustrate, by way of example, the principles of the invention.

DETAILED DESCRIPTION OF THE INVENTION

Figure 1:
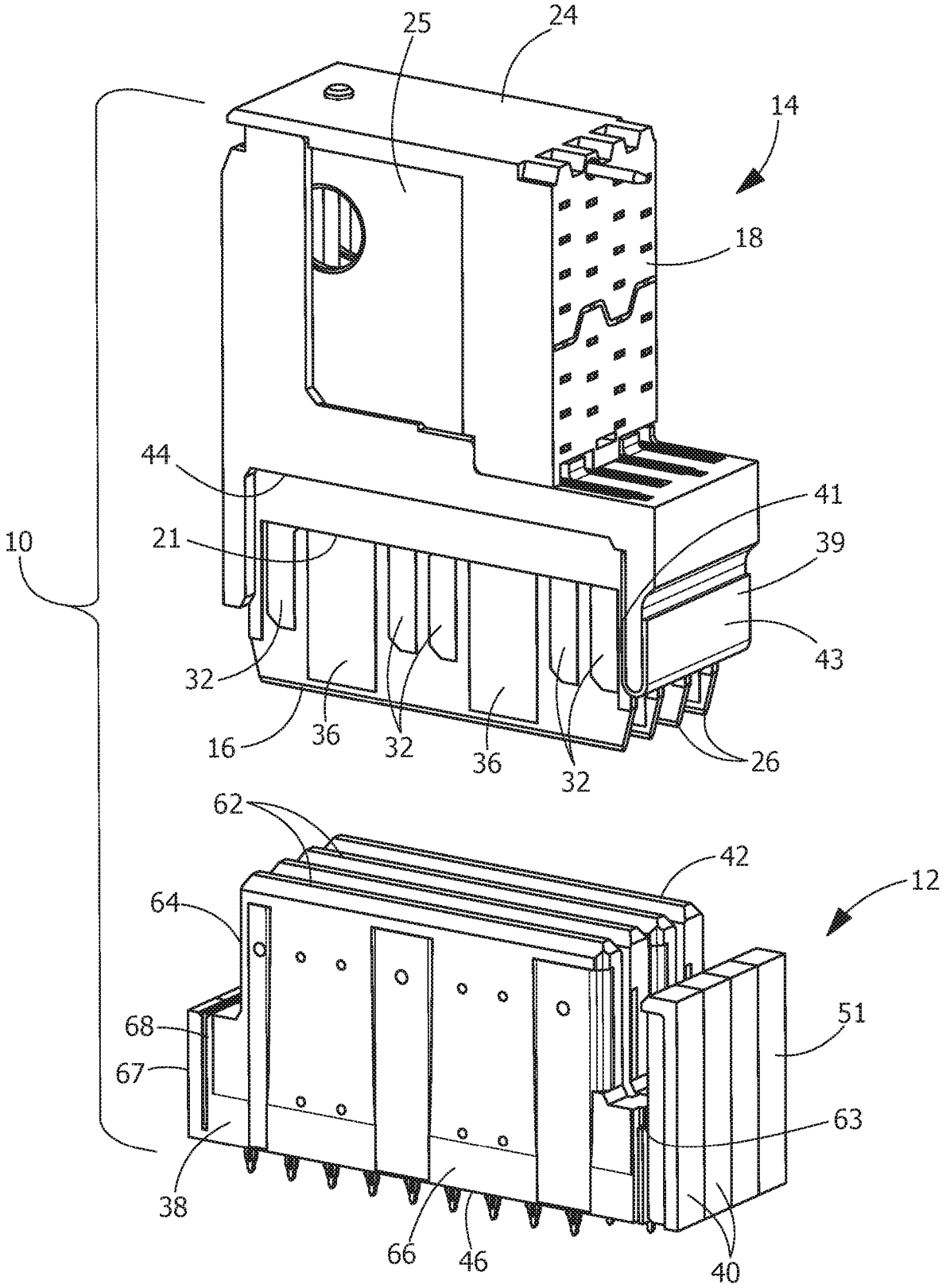
FIG. 1 is a perspective view of an illustrative printed circuit board connector assembly of the present invention with a mating connector positioned above the printed circuit board connector prior to mating therewith.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

Moreover, the features and benefits of the invention are illustrated by reference to the preferred embodiments. Accordingly, the invention expressly should not be limited to such embodiments illustrating some possible non-limiting combination of features that may exist alone or in other combinations of features, the scope of the invention being defined by the claims appended hereto.

FIG. 1 illustrates an electrical connector system 10 formed in accordance with an illustrative embodiment. The electrical connector system 10 includes a backplane connector 12 and a daughtercard connector 14 that are used to electrically connect a backplane circuit board (not shown) and a daughtercard circuit board (not shown). While the electrical connector system 10 is described herein with reference to backplane connectors 12 and daughtercard connectors 14, it is realized that the subject matter herein may be utilized with different types of electrical connectors other than a backplane connector or a daughtercard connector. The backplane connector 12 and the daughtercard connector 14 are merely illustrative of an illustrative embodiment of an electrical connector system 10 that interconnects a particular type of circuit board, namely a backplane circuit board, with a daughtercard circuit board.

In the illustrative embodiment shown, the daughtercard connector 14 constitutes a right angle connector wherein a mating interface 16 and mounting interface 18 of the daughtercard connector 14 are oriented perpendicular to one another. The daughtercard connector 14 is mounted to the daughtercard circuit board at the mounting interface 18. Other orientations of the interfaces 16, 18 are possible in alternative embodiments.

The daughtercard connector 14 includes a housing 24 holding a plurality of modules 25 which include substrates or circuit boards 26 therein. The housing 24 may be made from one or more components without departing from the scope of the invention. As shown in FIG. 4, each of the circuit boards 26 has individual signal pathways or traces 30 that extend between the mating interface 16 and the mounting interface 18, although the particular configuration of the individual signal pathways or traces 30 may vary from circuit board 26 to circuit board 26. In the illustrative embodiment shown, various configurations of the individual signal pathways or traces 30 are arranged in pairs 28 carrying differential signals. The signal traces 30 have signal conductive pads 32 provided proximate the mating interface 16. The signal traces 30 are configured to be mated with and electrically connected to the signal contacts 48 (FIG. 3) of the backplane connector 12. The individual signal pathways or traces 30 are positioned on first surfaces 27 of the circuit boards 26. While circuit boards are shown and described, the modules 25 may have other configurations, including, but not limited to, housings with overmolded contacts in place of the traces.

Each of the circuit boards 26 has individual ground pathways or traces 34 that extend between the mating interface 16 and the mounting interface 18, although the particular configuration of the individual ground pathways or traces 34 may vary from circuit board 26 to circuit board 26. The ground traces 34 have ground conductive pads 36 provided proximate the mating interface 16. The ground traces 34 are configured to be mated with, and electrically connected to, the ground contacts 50 (FIG. 3) or the shield or ground plates 52 (FIG. 3) of the backplane connector 12. The individual ground pathways or traces 34 are positioned on the first surfaces 27 of the circuit boards 26.

As shown in FIG. 4, respective circuit boards 26 have an additional grounding pathway or trace 35 which extends between an individual signal pathway or trace 30 of a differential pair 28 and a side edge 37 of the circuit board 26. The grounding traces 35 are provided proximate the side edges 37. The ground pathways or traces 35 are positioned on the first surfaces 27 of the circuit boards 26. The signal traces 30, the ground traces 34 and the ground traces 35 of each module are positioned inline.

Each of the circuit boards 26 may include ground traces 33 (FIG. 2) on a second surface 29 of each substrate 26. The second surface 29 being opposed and spaced from the first surface 27. The ground traces extend from proximate the mating interface 16 and the mounting interface 18.

Figure 3:
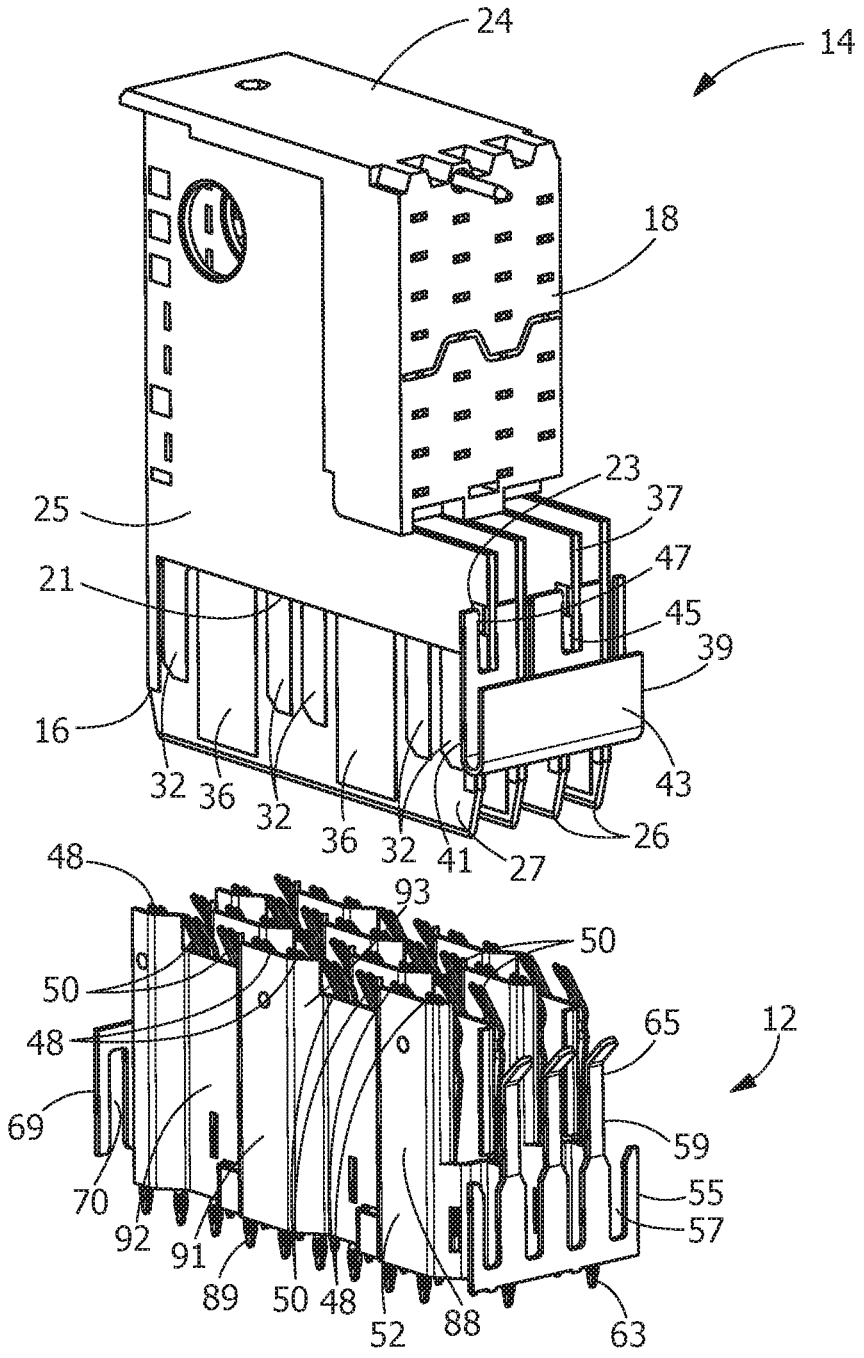
FIG. 3 is a perspective view of the printed circuit board connector assembly of FIG. 1, with the portions of the housings removed.
Figure 4:
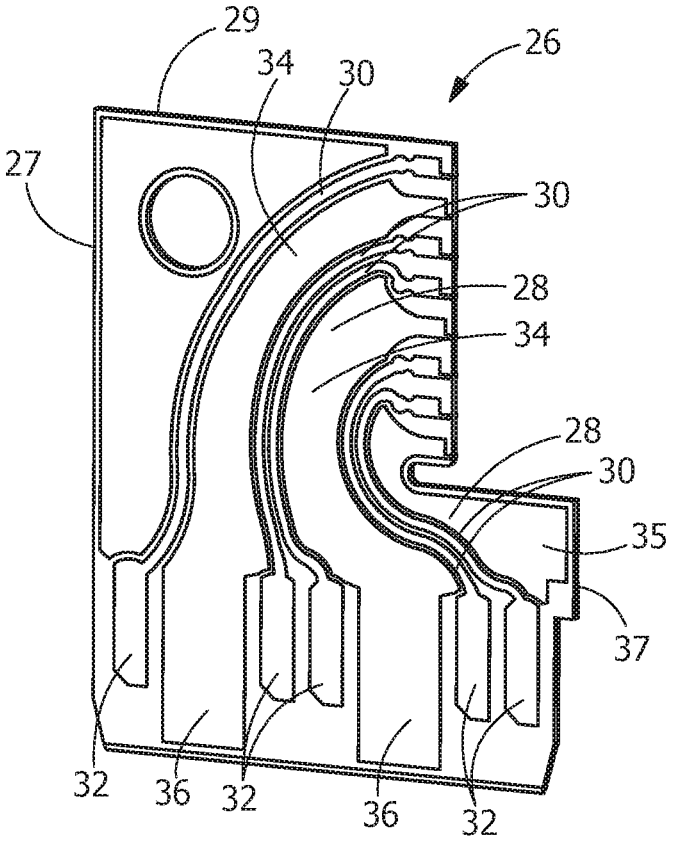
FIG. 4 is a front perspective of an illustrative substrate used in the printed circuit board connector assembly of FIG. 1.

As shown in FIG. 3, a ground contact 39 is positioned proximate the side edges 37 of the circuit boards 26. In the illustrative embodiment shown, the ground contact 39 has a generally J-shaped configuration with a circuit board engaging section 41 and a backplane connector engaging section 43. The circuit board engaging section 41 has slots 45 for receiving the side edges 37 of the circuit boards 26. Respective slots 45 have contact projections 47 which extend into the slots 45 to make a mechanical and electrical engagement with the ground pathways or traces 35 positioned on the first surfaces 27 of respective circuit boards 26.

As shown in FIG. 3, the modules 25 have recesses 21 which allows the circuit pads 32 of the signal pathways or traces 30 and the circuit pads 36 of the ground pathways or traces 34 to be exposed. The modules 25 also have openings 23 (FIG. 3) which allow a portion of the ground pathways or traces 35 to be exposed.

Figure 2:
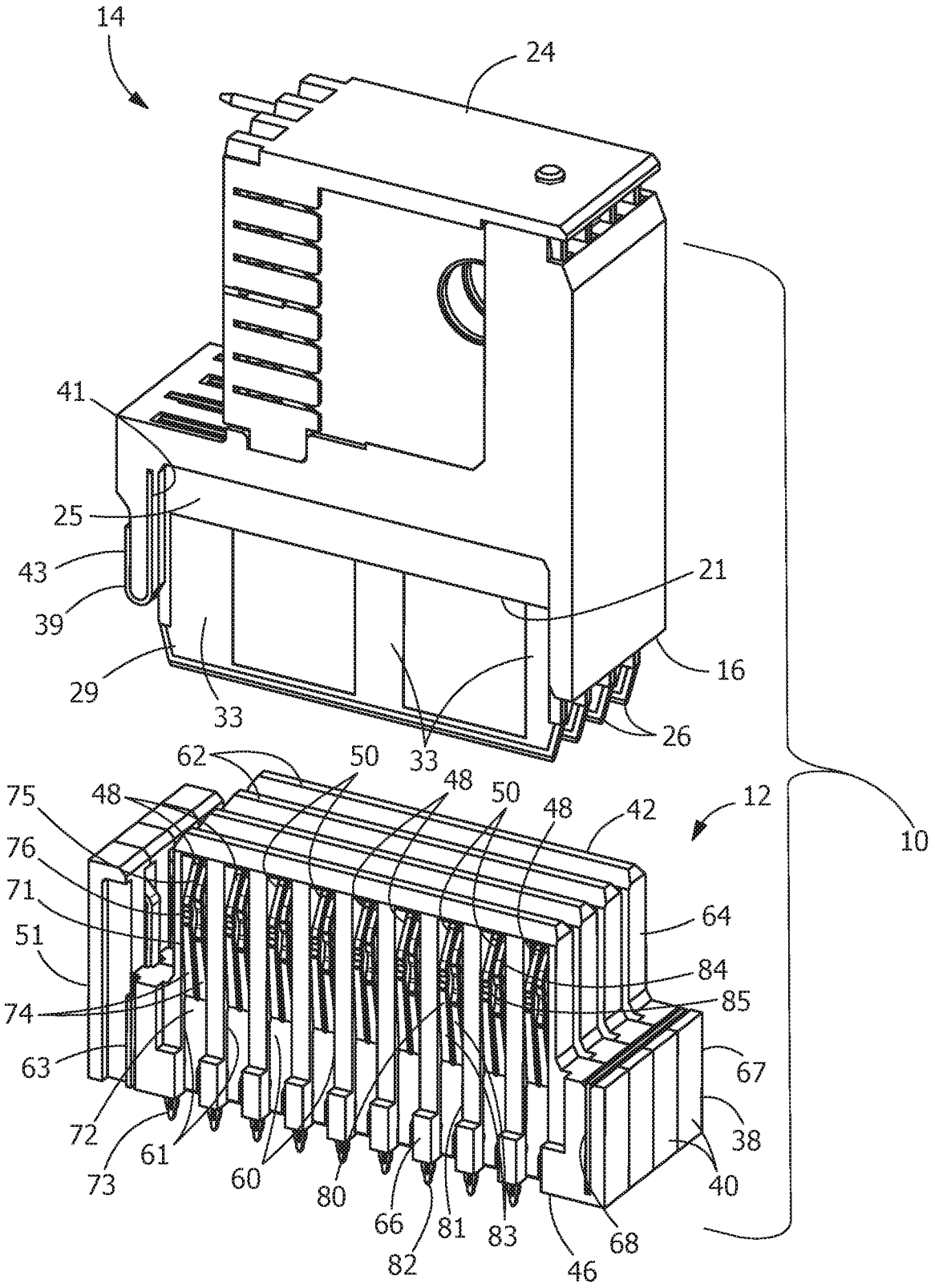
FIG. 2 is a back perspective view of the printed circuit board connector assembly of FIG. 1.

As shown in FIGS. 1 and 2, the backplane connector 12 includes a housing 38 which is made from a plurality of modules 40. Each of the modules 40 has a mating end 42 that is configured to be positioned in recess 44 of the daughtercard connector 14 during mating. Each of the modules 40 has a mounting end 46 which is mounted to the backplane circuit board. Each of the modules 40 holds a plurality of individual signal contacts 48 (as shown in FIG. 3) that extend between the mating end 42 and the mounting end 46.

In the illustrative embodiment shown, the individual signal contacts 48 are arranged in pairs carrying differential signals.

As shown in FIG. 2, each of the modules 40 holds a plurality of ground contacts 50 that extend between the mating end 42 and the mounting end 46. The ground contacts 50 are electrically connected to shield or ground plates 52 that extend between the mating end 42 and the mounting end 46.

Each of the modules 40 include a plurality of signal cavities or channels 60 extending between the mating end 42 and the mounting end 46. The signal channels 60 extend along a mating axes and receive the signal contacts 48. When the backplane connector 12 and daughtercard connector 14 are mated, the signal conductive pads 32 of the mating signal traces 30 of the daughtercard connector 14 are also received in the signal channels 60.

The modules 40 include plate receiving slots (not shown) that receive the shield or ground plates 52. The modules 40 include a plurality of ground cavities or channels 61 extending between the mating end 42 and the mounting end 46. The ground channels 61 are open to the plate receiving slots. The ground channels 61 provide access to the shield or ground plates 52 held in the plate receiving slots. The ground channels 61 extend along the mating axes and receive the ground contacts 50. The plate receiving slots extend along the mating axes and receive portions of the shield or ground plates 52. When the backplane connector 12 and daughtercard connector 14 are mated, ground conductive pads 36 of the ground traces 34 of the daughtercard connector 14 are also received in the ground channels 61. Any number of ground channels 61 may be provided. The ground channels 61 may be provided at any locations within the modules 40 and the housing 38. In an exemplary embodiment, the ground channels 61 are generally positioned between pairs of signal channels 60, to correspond to positions of the ground contacts 50, the shield or ground plates 52 and the ground conductive pads 36 of the ground traces 34 between pairs of the signal contacts 48 and mating signal traces 32.

The ground contacts 50 and the shield or ground plates 52 extend about the periphery of the pairs of signal contacts 48 and surround the pairs of signal contacts 48 to provide electrical shielding for the pairs of signal contacts 48. In an exemplary embodiment, shielding is provided by the ground contacts 50 and the shield or ground plates 52 along the length of the signal contacts 48. The ground contacts 50 and the shield or ground plates 52 surround portions of the mating signal traces 30 when the connectors 12, 14 are mated. The ground contacts 50 and the shield or ground plates 52 provide shielding along the entire mating interface with the mating signal traces 32. The ground contacts 50 and the shield or ground plates 52 may control electrical characteristics throughout the housing 38, such as by controlling cross talk, signal radiation, impedance or other electrical characteristics.

In the illustrative embodiment shown in FIGS. 1 through 3, the housing 38 of the backplane connector 12 has four modules 40 which are positioned adjacent to each other. However, other number of modules 40 may be provided, for example 8 or 16 modules may be adjacent to each other. Module receiving slots 62 are provided between adjacent modules 40. The module receiving slots 62 are positioned adjacent mating connector receiving sections 64 of the modules 40. Each circuit board receiving slot 62 extends from the mating end 42 of the module toward the mounting end 46.

Each module 40 has a base section 66 which extends from the mounting end 46 toward the mating end 42. Each of the base sections 66 has an end section 67 which extends beyond the connector receiving section 64, as shown in FIGS. 1 and 2. Each of the end sections 67 has a clip receiving slot 68 which extends from a top surface 69 of the end section 67 toward the mounting end 46. However, other variations of the slot 68 may be provided, such as, but not limited to, the slot may extend from the bottom surface of the end section 67.

When the modules 40 are properly assembled, clips 69 (as shown in FIG. 3) are inserted into the clip receiving slots 68 to properly position and retain the modules 40 in position relative to each other. The clips 69 may have cavities 70 provided therein which cooperate with projections (not shown) in the clip receiving slots 68 to more accurately position and maintain the modules 40 relative to each other.

Each of the base sections 66 has an end section 51 which extends beyond the connector receiving section 64, as shown in FIGS. 1 and 2. Each of the end sections 51 has a clip receiving slot 53 which extends from the mounting end 46.

When the modules 40 are properly assembled, clips 55 (as shown in FIG. 3) are inserted into the clip receiving slots 53 to properly position and retain the modules 40 in position relative to each other. The clips 55 may have cavities 57 provided therein which cooperate with projections (not shown) in the clip receiving slots 55 to more accurately position and maintain the modules 40 relative to each other. The clips 55 have ground contacts 59 and circuit board mounting sections 63 provided thereon. The ground contacts 59 are resilient arms with engagement portions 65. In the illustrative embodiment shown, the circuit board mounting sections 63 are compliant portions, although other configurations may be used.

Referring to FIG. 2, the signal channels 60 and ground channels 61 are shown. As previously described, the signal channels 60 are configured to receive the signal contacts 48 therein. Each signal contact 48 has a mating contact receiving section 71, a securing section 72 and circuit board mounting section 73. In the illustrative embodiment shown, the contact receiving section 71 includes two resilient arms 74 with lead in portions 75 and engagement portions 76. The resilient arms 74 are configured to press against the signal conductive pads 32 of the signal traces 30 when the daughter card connector 14 is mated to the backplane connector 12. The circuit board mounting section 73 has a compliant portion, such as an eye of the needle pin, although other configurations may be used. Each of the circuit board mounting section 73 has a longitudinal axis which is offset from the longitudinal axis of the securing section 72 and the mating contact receiving section 71.

As previously described, the ground channels 61 are configured to receive the ground contacts 50 therein. Each ground contact 50 has a mating contact receiving section 80, a securing section 81 and circuit board mounting section 82. In the illustrative embodiment shown, the contact receiving section 80 includes two resilient arms 83 with lead in portions 84 and engagement portions 85. The resilient arms 83 are configured to press against the ground conductive pads 36 of the ground traces 34 when the daughter card connector 14 is mated to the backplane connector 12. The circuit board mounting sections 82 have compliant portions, although other configurations may be used. Each of the circuit board mounting sections 82 has a longitudinal axis which is offset from the longitudinal axis of the securing section 81 and the mating contact receiving section 80.

As shown in FIG. 3, the shield or ground plates 52 have shielding sections 88 and circuit board mounting sections 89. In the illustrative embodiment, the shielding sections 88 are proximate to or abut against the backplane circuit board when the backplane connector 12 is positioned on the circuit board. The shield or ground plates 52 are non-planar.

The circuit board mounting sections 89 have compliant portions, such as an eye of the needle pin, although other configurations may be used. The shielding sections 88 of the shield or ground plates 52 have a wavy configuration to pass between and along pairs of signal contacts 48. Optionally, the shielding sections 88 may be located as far from the signal contacts 48 as possible. For example, the shielding sections 88 may be shaped to be positioned generally equidistant from adjacent signal contacts 48.

The shielding sections have first sections 91 and second sections 92 which are positioned in a different plane than the first sections 91. Transition sections 93 extend between the first sections 91 and the second sections 92. In the illustrative embodiment, the transition sections 93 are angled with respect to the first sections 91 and the second sections 92. Alternatively, the transition sections 93 may curved or radiused rather than angled.

The ground contacts 50 and the shield or ground plates 52 entirely peripherally surround the pairs of signal contacts 48 to provide electrical shielding for the pairs of signal contacts 48. Minimal gaps or spaces, which could allow EMI leakage between pairs of signal contacts 36, are provided through or between the ground contacts 50 and the shield or ground plates 52.

The shield or ground plates 52 extend along multiple pairs of signal contacts 48. The shield or ground plates 52 engage the ground contacts 50 to electrically common the ground contacts 50 and the shield or ground plates 52 together. The ground contacts 50 and the shield or ground plates 52 form cavities around the pairs of signal contacts 48. The cavities may have any shape depending on the shapes of the ground contacts 50 and the shield or ground plates 52, including, but not limited to, a hexagonal prism shape.

When the backplane connector 12 and the daughter card connector 14 properly mated: the signal contacts 48 of the backplane connector 12 engage the signal conductive pads 32 of the signal traces 30; the ground contacts 50 of the backplane connector 12 engage the ground conductive pads 36 of the ground traces 34; and the ground plates 52 engage the ground traces on the second surface 29 of each substrate 26.

In addition, when the backplane connector 12 and the daughter card connector 14 are properly mated, the engagement portions 65 of the ground contacts 59 of the clip 55 of the backplane connector 12 mechanically and electrically engage the backplane connector engaging section 43 of the ground contact 39 of the daughtercard connector 14. As the projections 47 of the ground contact 39 are in electrical engagement with the ground pathways or traces 35 positioned on the first surfaces 27 of respective circuit boards 26, an electrical ground pathway is provided between the ground pathways or traces 35, the ground contact 39, and the clip 55. The addition grounding pathways provide additional balanced impedance and grounding protection to the signal contacts 48 of the backplane connector 12 and the signal conductive pads 32 of the signal traces 30 which are positioned proximate to the side edges 37.

Referring to FIGS. 5 through 8, an alternate illustrative connector assembly 110 is shown which has additional grounding pathways for additional grounding protection and balanced impedance to the signal contacts 148 of the backplane connector 112 and the signal conductive pads 132 of the signal traces 130 which are positioned proximate to the side edges 137.

In this embodiment, respective circuit boards 126 have an additional grounding pathway or trace 135 which extends between an individual signal pathway or trace 130 of a differential pair 128 and a side edge 137 of the circuit board 126. The grounding traces 135 are provided proximate the side edges 137. The ground pathways or traces 135 are positioned on the first surfaces 127 of the circuit boards 126. The ground pathways or traces 135 have ground conductive pads 119 which extend proximate the mating interface 116. The ground conductive pads 119 are positioned in a housing extension 117 of the housing 124 of the daughter card connector 114. While circuit boards 126 are shown and described, the circuit boards may be replaced with modules with other types of contacts, including, but not limited to, housings with overmolded contacts in place of the traces.

A partition wall 115 is provided between the housing 124 and the housing extension 117. The partition wall 115 allows the connector assembly 110 to be mated to a backplane connector which does not have an additional end section 151. This allows the connector assembly 110 to be used with the backplane connector 112 as shown or to be backwardly compatible with other known backplane connectors.

Figure 6:
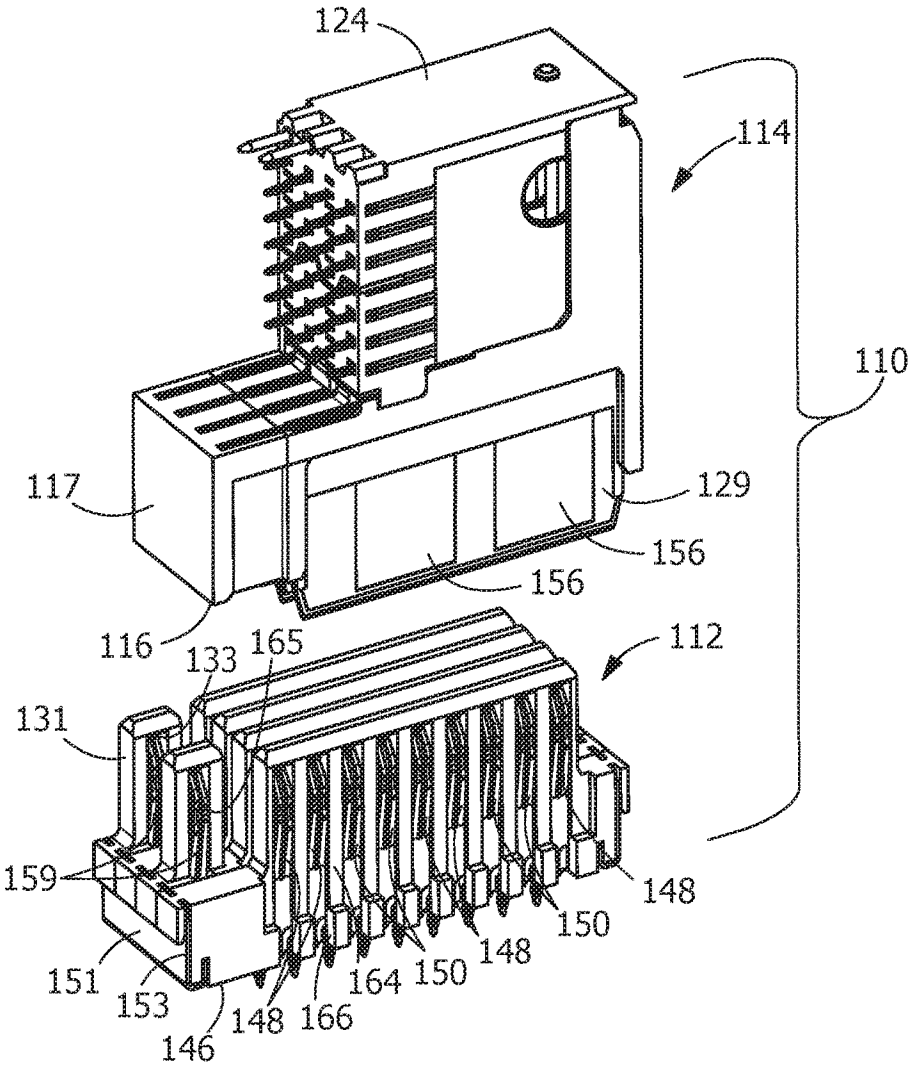
FIG. 6 is a back perspective view of the printed circuit board connector assembly of FIG. 5.
Figure 5:
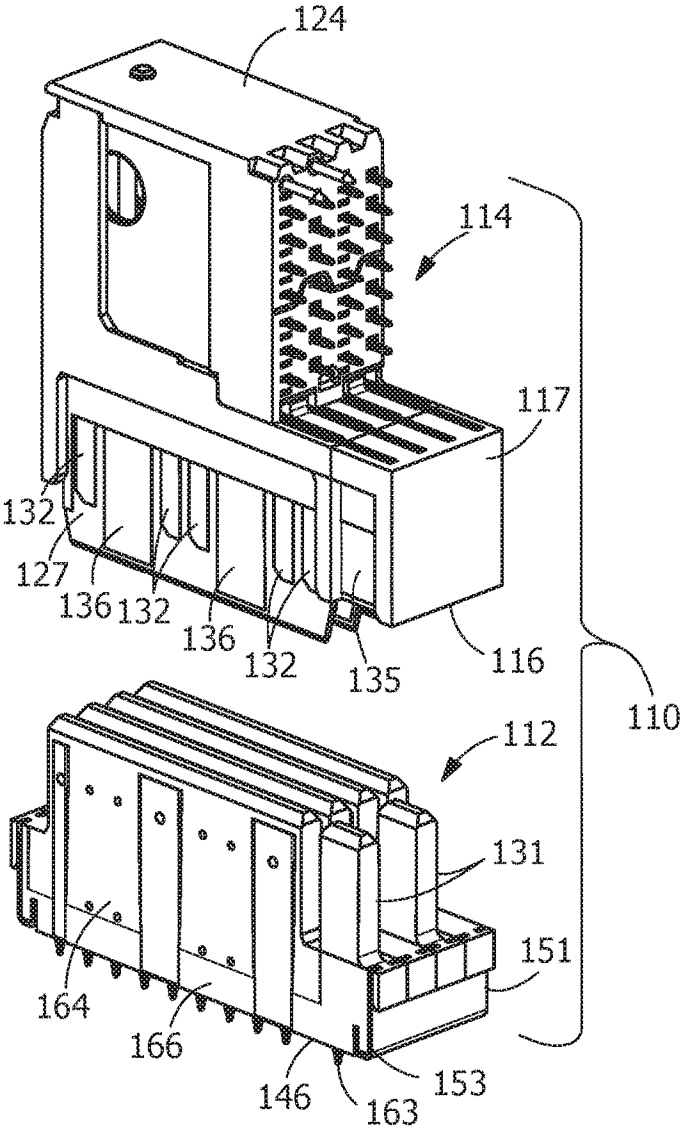
FIG. 5 is a perspective view of an alternate illustrative printed circuit board connector assembly of the present invention with a mating connector positioned above the printed circuit board connector prior to mating therewith.
Figure 7:
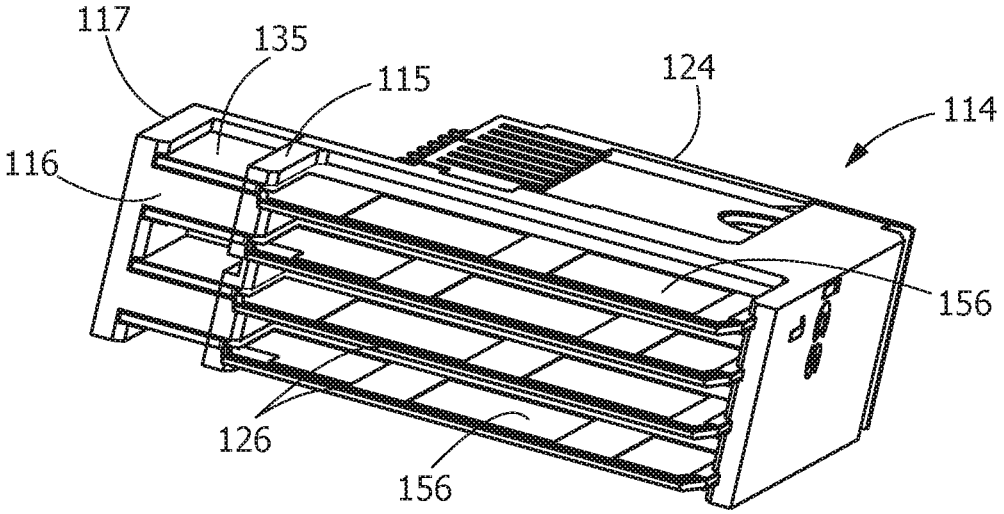
FIG. 7 is a bottom perspective view of a daughter card connector of the printed circuit board connector assembly of FIG. 5.
Figure 8:
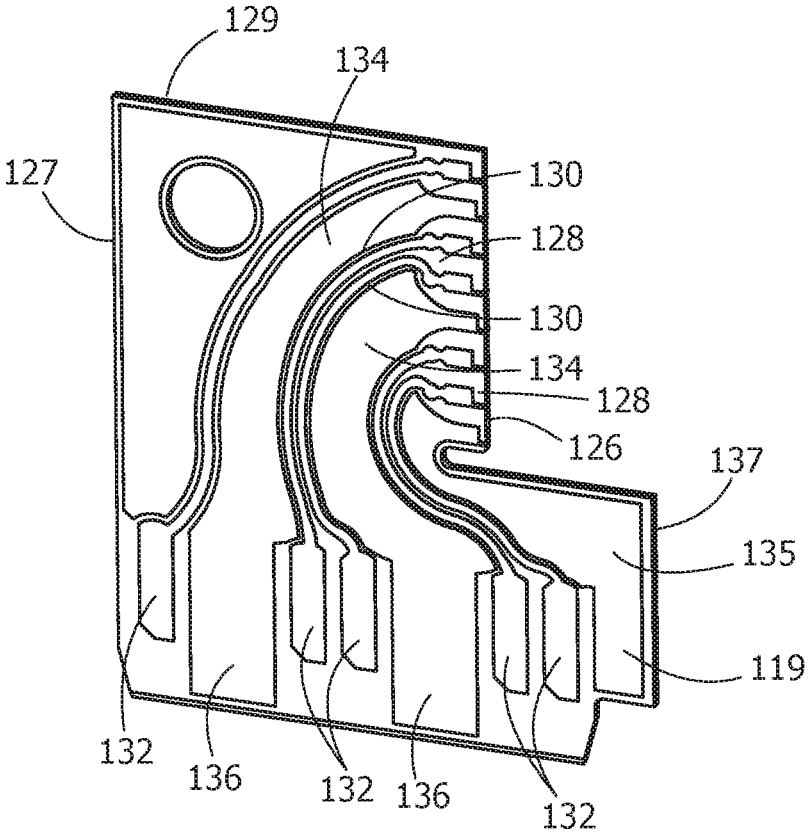
FIG. 8 is a front perspective of an illustrative substrate used in the printed circuit board connector assembly of FIG. 5.
Figure 9:
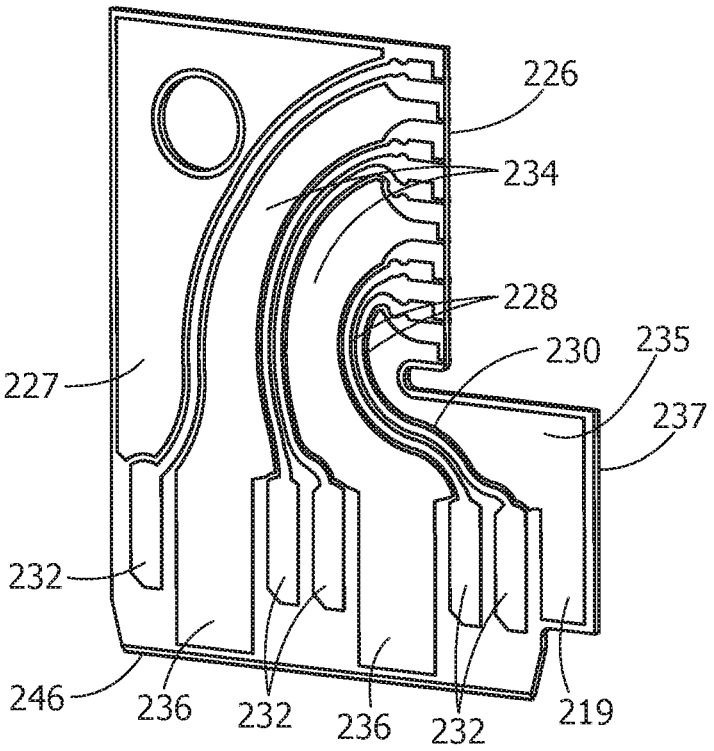
FIG. 9 is a front perspective of an alternate illustrative substrate used with a third alternate printed circuit board connector assembly.
Figure 10:
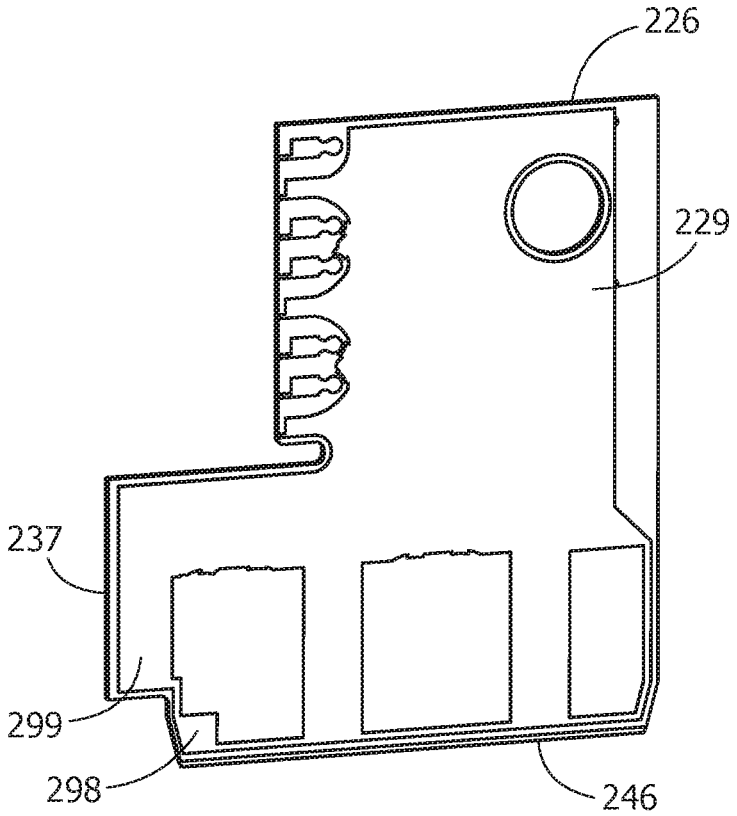
FIG. 10 is a back perspective of the substrate of FIG. 9.
Figure 11:
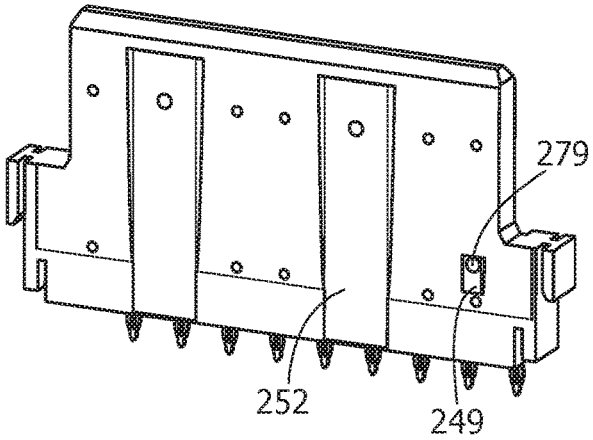
FIG. 11 is back perspective of a module of a backplane connection for use with the substrate of FIG. 9.
Figure 12:
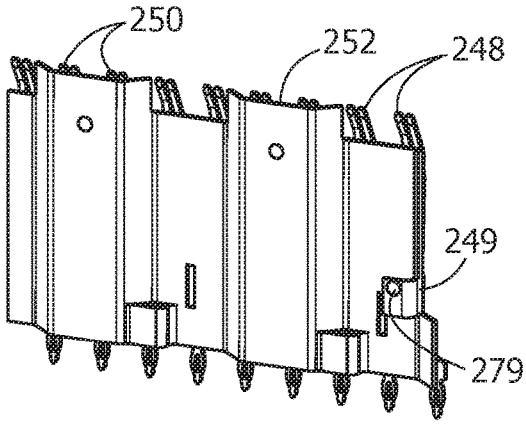
FIG. 12 is back perspective of a module of a backplane connection for use with the substrate of FIG. 9 with the housing removed.
Figure 13:
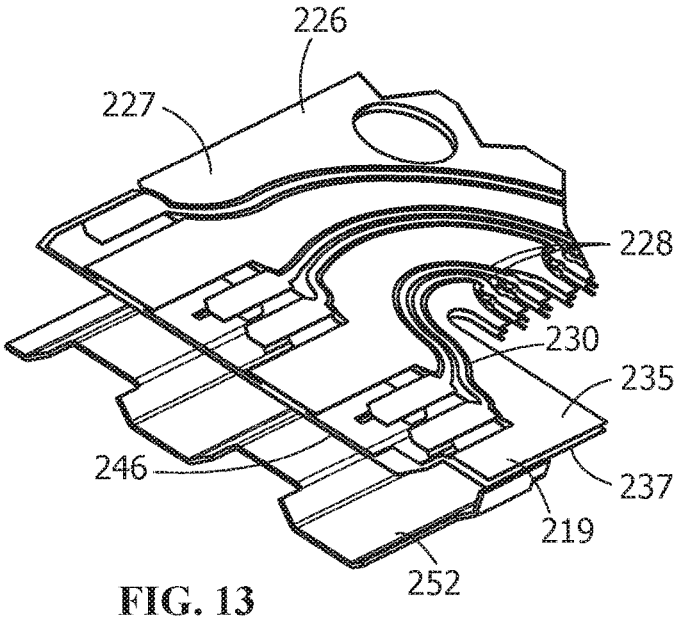
FIG. 13 is a partial perspective view of the substrate of FIG. 9 in electrical engagement with a shield member of FIG. 12.

Each of the base sections 166 of the backplane connector 112 has an end section 151 which extends beyond the connector receiving section 164, as shown in FIGS. 5 and 6. Each of the end sections 151 has a clip receiving slot 153 which extends from the mounting end 146.

Ground contacts 159 are provided in the end sections 151 of the base sections 166. The ground contacts 159 have resilient arms with engagement portions 165 and circuit board mounting sections 163. In the illustrative embodiment shown, the circuit board mounting sections 163 are compliant portions, although other configurations may be used. Protective housings 131 are provided on the end sections 151 of the base sections 166. The protective housings 131 have ground contact receiving channels 133 which receive the ground contacts 159 therein.

When the backplane connector 112 and the daughter card connector 114 properly mated: the signal contacts 148 of the backplane connector 112 engage the signal conductive pads 132 of the signal traces 130; the ground contacts 150 of the backplane connector 112 engage the ground conductive pads 136 of the ground traces 134; and the ground plates 152 engage the ground traces 156 on the second surface 129 of each substrate 126.

In addition, when the backplane connector 112 and the daughter card connector 114 properly mated, the engagement portions 165 of the ground contacts 159 of the backplane connector 112 mechanically and electrically engage the ground conductive pads 119 of the ground pathways or traces 135 of the daughtercard connector 114, thereby providing an electrical ground pathway between the ground pathways or traces 135 and the ground contact 159. The addition grounding pathways provide balanced impedance and additional grounding protection to the signal contacts 148 of the backplane connector 112 and the signal conductive pads1 32 of the signal traces 130 which are positioned proximate to the side edges 137.

FIGS. 9 through 13 illustrative another illustrative embodiment. In this embodiment, the shield or ground plates 252 have projections or arms 249 with projections or dimples 279 which extend therefrom. The projections or dimples 279 extend through openings 297 of the modules 240. The projections or dimples may also have other configurations, such as, but not limited to, resilient contact beams.

Respective circuit boards 226 have an additional grounding pathway or trace 235 which extends between an individual signal pathway or trace 230 of a differential pair 228 and a side edge 237 of the circuit board 226. The grounding traces 235 are provided proximate the side edges 237. The ground pathways or traces 235 are positioned on the first surfaces 227 of the circuit boards 226. The ground pathways or traces 235 have ground conductive pads 219 which extend proximate the mounting end 246. While circuit boards 226 are shown and described, the circuit boards may be replaced with modules with other types of contacts, including, but not limited to, housings with overmolded contacts in place of the traces.

The projections or dimples 279 of the ground plates 252 engage ground portions 298 of the ground traces 299 on the second surfaces 229 of the substrates 226. Portions 298 of the ground traces 299 are provided proximate the side edges 237. The ground traces 299 are electrically connected to the ground traces 219 on the first surface 227 by plated through hole vias or by other known methods or components.

When the backplane connector and the daughter card connector are properly mated: the signal contacts 248 of the backplane connector engage the signal conductive pads 232 of the signal traces 230; the ground contacts 250 of the backplane connector engage the ground conductive pads 236 of the ground traces 234; and the ground plates 252 engage the ground traces 299 on the second surface 229 of each substrate 226.

In addition, when the backplane connector and the daughter card connector 214 properly mated, the projections or dimples 279 of the ground plates 252 of the backplane connector mechanically and electrically engage the portions 298 of the ground traces 299 that are provided proximate the side edges 237 of the daughtercard connector 214. The addition grounding pathways provide balanced impedance and additional grounding protection to the signal contacts 248 of the backplane connector and the signal conductive pads 232 of the signal traces 230 which are positioned proximate to the side edges 237.

Figure 14:
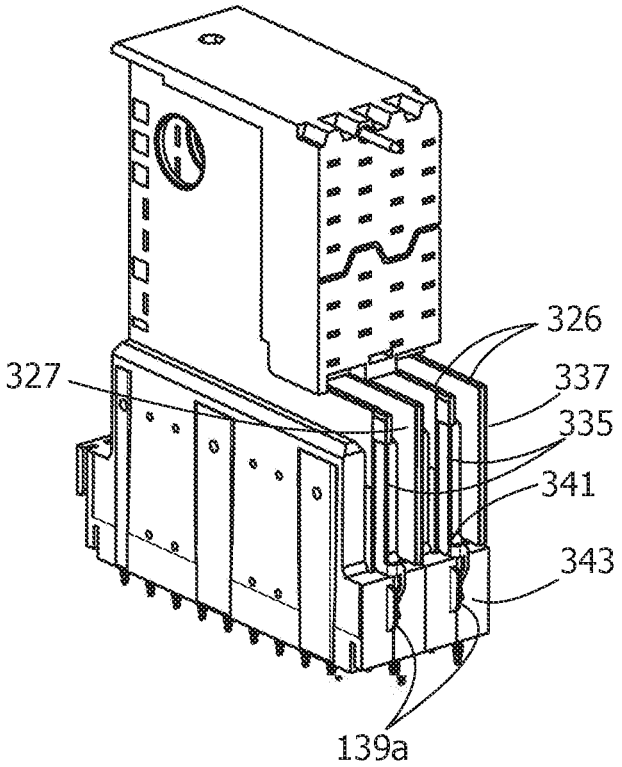
FIG. 14 is a perspective view of a fourth alternate illustrative printed circuit board connector assembly of the present invention with portions of the housing removed.
Figure 15:
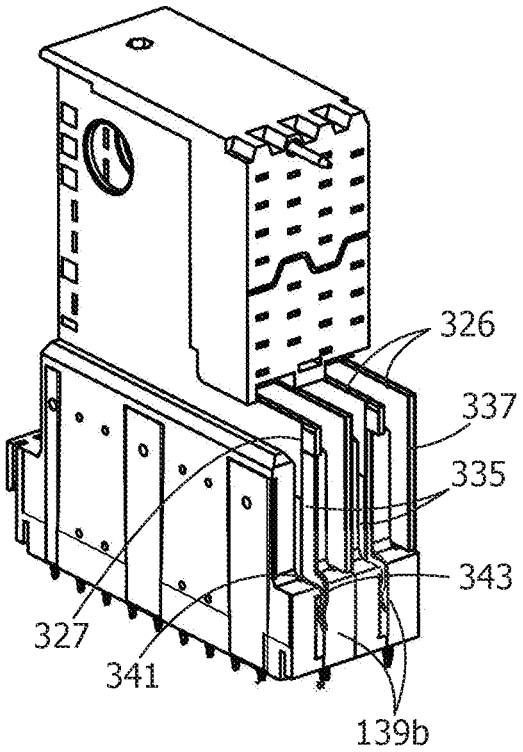
FIG. 15 is a perspective view of a fifth alternate illustrative printed circuit board connector assembly of the present invention with portions of the housing removed.

FIGS. 14 and 15 illustrate other illustrative embodiments. In these embodiments, respective circuit boards 326 have an additional grounding pathway or trace 335 which extends between an individual signal pathway or trace of a differential pair and a side edge 337 of the circuit board 326. The grounding traces 335 are provided proximate the side edges 337. The ground pathways or traces 335 are positioned on the first surfaces 327 of the circuit boards 326. While circuit boards 326 are shown and described, the circuit boards may be replaced with modules with other types of contacts, including, but not limited to, housings with overmolded contacts in place of the traces.

Ground contacts 139*a*, 139*b* are positioned proximate the side edges 337 of the circuit boards 326. The ground contacts 139*a*, 139*b* have circuit board engaging sections 341 and backplane connector engaging sections 343. The circuit board engaging sections 341 may be mechanically and electrical secured to the grounding pathway or trace 335 by soldering or other known methods. The backplane connector engaging sections 343 are configured to mechanically and electrically engage grounding contacts of the backplane connector.

Figure 17:
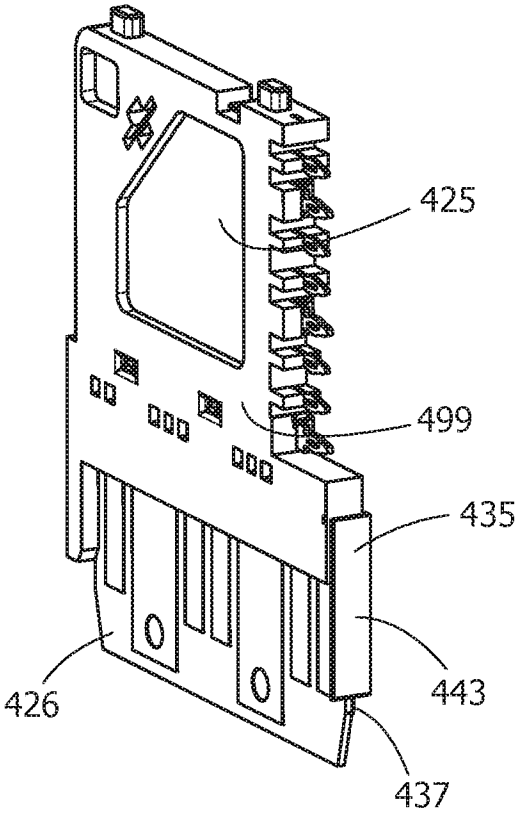
FIG. 17 is a front perspective of the module of FIG. 16.
Figure 16:
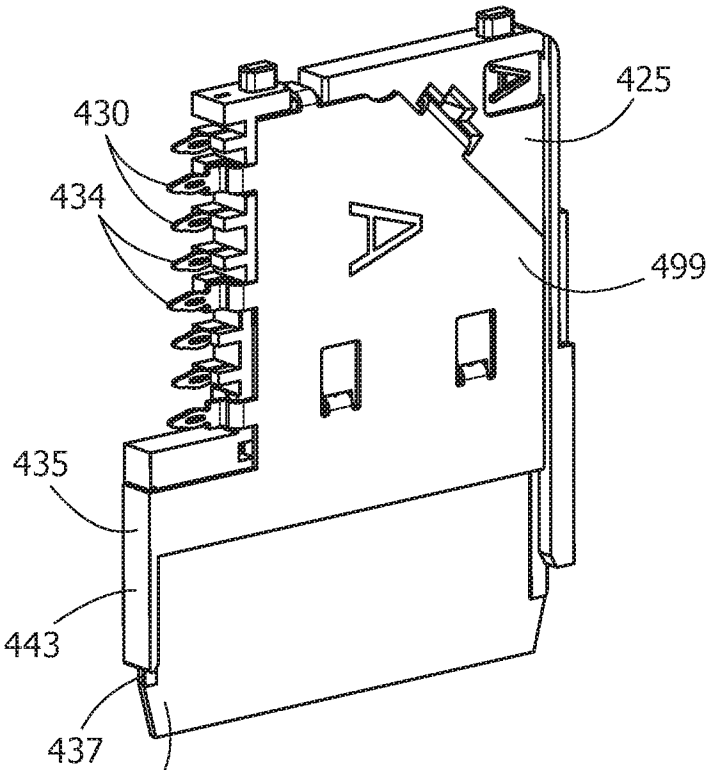
FIG. 16 is a back perspective view of an alternate illustrative module for use in a daughter card connector of a sixth alternate connector assembly, the modules having overmolded contacts.

FIGS. 16 and 17 illustrate a module 425 with overmolded signal contacts 430 and overmolded ground contacts 434. The module 425 has an additional shielding element 499. The additional shielding elements 499 of the modules 425 have backplane connector engaging sections 443 which are positioned proximate a side edge 437 of the circuit board 426 to provide additional grounding pathway 435. The backplane connector engaging sections 443 are configured to mechanically and electrically engage grounding contacts of the backplane connector.

While the invention has been described with reference to a preferred embodiment, it will be understood by those skilled in the art that various changes may be made and equivalents may be substituted for elements thereof without departing from the spirit and scope of the invention as defined in the accompanying claims. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. An electrical connector assembly for which has balanced impedance and shielding, the electrical connector assembly comprising:

a first connector housing having first modules positioned therein, the first modules having first mating ends and first mounting ends, the first modules having first surfaces and oppositely facing second surfaces, signal pathways provided on the first surfaces, the signal pathways being arranged in differential pairs, first ground pathways provided on the first surfaces and extending from the first mating ends to the first mounting ends, each of the first ground pathways positioned adjacent the signal pathways, second ground pathways provided on the first surfaces, the second ground pathways positioned between side surfaces of the modules and respective signal pathways of the signal pathways;

a second connector housing having second modules positioned therein, the second modules having second mating ends and second mounting ends, signal contacts positioned in the second modules, the signal contacts extending between the second mating ends and the second mounting ends, the signal contacts being arranged in pairs to carry differential signals, first ground contacts positioned in the modules, the ground contacts extending between the mating ends and the mounting ends, the first ground contacts being positioned adjacent to respective signal contacts of the signal contacts, second ground contacts positioned in the modules, the second ground contacts positioned between side surfaces of the second modules and respective signal contacts of the signal contacts;

wherein the second ground pathways engage the second ground contacts of the second modules to balance the differential pairs of signal pathways and reduce crosstalk.

2. The electrical connector assembly as recited in claim 1, wherein the modules include third ground pathways on the second surfaces of the substrates, the third ground pathways extend from proximate the mating ends.

3. The electrical connector assembly as recited in claim 1, wherein a first connector ground contact is positioned proximate the side edges of the modules of the first connector.

4. The electrical connector assembly as recited in claim 3, wherein the first connector ground contact has a module engaging section and a backplane connector engaging section.

5. The electrical connector assembly as recited in claim 4, wherein the first connector ground contact has a generally J-shaped configuration.

6. The electrical connector assembly as recited in claim 1, wherein a module engaging section of a first ground contact positioned proximate the side edges of the modules has slots for receiving the side edges of the module, respective slots of the slots have contact projections which extend into the respective slots to make a mechanical and electrical engagement with the second ground pathways positioned on the first surfaces of the module.

7. The electrical connector assembly as recited in claim 6, wherein the modules of the second connector housing have base sections with end section which extend beyond a connector receiving section, the end sections have clip receiving slots.

8. The electrical connector assembly as recited in claim 7, wherein clips are positioned in the clip receiving slots to properly position and retain the modules in position relative to each other, the clips have second ground contacts with engagement portions, the engagement portions of the second ground contacts mechanically and electrically engage the second connector engaging section of the first connector ground contact.

9. The electrical connector assembly as recited in claim 8, wherein the clips have cavities provided therein.

10. The electrical connector assembly as recited in claim 8, wherein the first modules have openings which allow a portion of the second ground pathways to be exposed to allow the contact projections which extend into the respective slots to make a mechanical and electrical engagement with the second ground pathways positioned on the first surfaces of the module.

11. The electrical connector assembly as recited in claim 1, wherein the second ground pathways have ground conductive pads which extend proximate the mating ends, the ground conductive pads are positioned in a housing extension of the housing of the first connector, a partition wall is provided between the housing and the housing extension.

12. The electrical connector assembly as recited in claim 11, wherein the modules of the second connector housing have base sections with end sections which extend beyond a connector receiving section, the end sections have contact receiving slots.

13. The electrical connector assembly as recited in claim 12, wherein the second ground contacts are provided in the end sections of the base sections.

14. The electrical connector assembly as recited in claim 13, wherein the ground contacts have resilient arms with engagement portions and module mounting sections.

15. The electrical connector assembly as recited in claim 14, protective housings are provided on the end sections of the base sections, the protective housings have ground contact receiving channels which receive the second ground contacts therein.

16. The electrical connector assembly as recited in claim 2, wherein the second modules have ground plates with arms with projections which extend therefrom, the projections extend through openings of the modules.

17. The electrical connector assembly as recited in claim 16, wherein the projections or dimples of the ground plates engage the third ground pathways on the second surfaces of the substrates.

18. The electrical connector assembly as recited in claim 1, wherein ground contacts are positioned proximate the side edges of the module, the ground contacts have module engaging sections and second connector engaging sections, the module engaging sections are mechanically and electrical secured to the second grounding pathway.

19. The electrical connector assembly as recited in claim 1, wherein the second ground pathways are positioned on shielding elements of the first modules of the first connectors.

20. The electrical connector assembly as recited in claim 1, wherein the signal pathways, the first ground pathways and the second ground pathways are positioned inline.

* * * * *